US011325741B1

(12) United States Patent
Philips et al.

(10) Patent No.: US 11,325,741 B1
(45) Date of Patent: May 10, 2022

(54) TRAY WITH CELLULAR BACK AND SIDE WALLS

(71) Applicant: Packaging Corporation of America, Lake Forest, IL (US)

(72) Inventors: Nicholas A. Philips, Sugar Grove, IL (US); Scott M. Miller, Trenton, OH (US); Richard R. Gugel, Liberty Township, OH (US)

(73) Assignee: Packaging Corporation of America, Lake Forest, IL (US)

( * ) Notice: Subject to any disclaimer, the term of this patent is extended or adjusted under 35 U.S.C. 154(b) by 0 days.

(21) Appl. No.: 17/116,863

(22) Filed: Dec. 9, 2020

Related U.S. Application Data

(60) Provisional application No. 62/958,882, filed on Jan. 9, 2020.

(51) Int. Cl.
*B65D 5/44* (2006.01)
*B65D 5/00* (2006.01)
*B65D 5/20* (2006.01)

(52) U.S. Cl.
CPC ..... *B65D 5/443* (2013.01); *B65D 5/0035* (2013.01); *B65D 5/2009* (2013.01)

(58) Field of Classification Search
CPC .... B65D 5/443; B65D 5/0035; B65D 5/2009; B65D 5/22; B65D 5/003
USPC ..... 229/164, 167, 172, 918, 919, 186, 187, 229/191, 198.2, 915; 206/736, 744, 45.21
See application file for complete search history.

(56) References Cited

U.S. PATENT DOCUMENTS

| | | | | |
|---|---|---|---|---|
| 7,004,379 | B2 * | 2/2006 | Holdsworth | B65D 5/0035 229/164 |
| 7,708,187 | B2 | 5/2010 | Keefe, Jr. et al. | |
| 7,748,604 | B2 | 7/2010 | Keefe, Jr. et al. | |
| 8,864,014 | B2 | 10/2014 | Keefe | |
| 9,205,947 | B1 * | 12/2015 | Waldschmidt | B65D 5/445 |
| 2003/0141356 | A1 | 7/2003 | Sheffer | |
| 2008/0078821 | A1 * | 4/2008 | Keefe | B65D 5/18 229/167 |

OTHER PUBLICATIONS

Stackable Tray Design—2016.

* cited by examiner

*Primary Examiner* — Christopher R Demeree
(74) *Attorney, Agent, or Firm* — Klarquist Sparkman, LLP

(57) ABSTRACT

A tray has a back wall, at least two side walls, a front wall, and a bottom. The side walls have an inner side wall panel and an outer side wall panel, and a gap between the inner and outer side wall panels. The back wall has an outer back wall panel and an inner back wall panel, and a gap provided between the inner back wall panel and the outer back wall panel. The inner back wall panel has first and second side edges, a top edge, and a bottom edge. A first of the inner side wall panels has a back edge, a front edge, a top edge, and a bottom edge. A multilayered corner reinforcing structure couples the back edge of the first inner side wall panel to the first side edge of the inner back wall panel at a first corner of the tray.

21 Claims, 12 Drawing Sheets

TRAY WITH CELLULAR BACK AND SIDE WALLS

CROSS REFERENCE TO RELATED APPLICATION

The present application claims the benefit of U.S. Provisional Application No. 62/958,882, filed on Jan. 9, 2020. The entire disclosure of U.S. Provisional Application No. 62/958,882 is incorporated herein by reference in its entirety.

FIELD

The present application pertains to paperboard containers including cellular back and side walls with reinforced corners for improved stacking strength.

BACKGROUND

When displaying items in bulk, it can be beneficial to have a container, tray, or bin with a low front wall that allows a customer to view and retrieve products from the container. However, when made from materials such as corrugated paperboard, such trays tend to suffer from poor stacking strength, limiting the number of trays that can be stacked and/or the type, size, weight, etc., of the products that can be accommodated. Existing trays can also be laborious to assemble because multiple folding actions are required to erect the various walls, particularly the rear and side walls. Accordingly, there exists a need for improved trays for storing and displaying items.

SUMMARY

It can be desirable to have a tray used for product display purposes with enhanced stacking or vertical loading strength to support the stacking of loads, such as from other trays.

It can be also desirable to provide a tray comprising cellular back and side walls, a front wall and a bottom. With reference to the back and side walls, the term "cellular" refers to respective side and back walls having inner and outer spaced apart wall panels with a gap therebetween. Desirably the front wall is shorter than the back wall so that product on the tray is readily visible by, for example, a customer.

The trays described herein can be used in displaying a myriad of merchandise types and can be particularly useful in club and discount store applications.

By providing a tray with design features that enhance stacking strength, for a given loading, thinner paperboard material can be used for the tray while still supporting the same load without being crushed. The use of thinner material reduces the cost of the tray.

The description below is with respect to an example of a four-sided tray. The tray may have three, five or more sides and still include the features, such as the reinforced corner features described herein.

In a representative embodiment, a tray comprises a back wall, at least two side walls, a front wall, and a bottom. The side walls each comprise an inner side wall panel and an outer side wall panel, a gap being provided between the inner and outer side wall panels. The back wall comprises an outer back wall panel and an inner back wall panel, a gap being provided between the inner back wall panel and the outer back wall panel. The inner back wall panel comprises first and second side edges, a top edge, and a bottom edge.

A first of the inner side wall panels comprises a back edge, a front edge, a top edge, and a bottom edge. A multilayered corner reinforcing structure couples the back edge of the first inner side wall panel to the first side edge of the inner back wall panel at a first corner of the tray.

In any or all of the disclosed embodiments, the multilayered corner reinforcing structure is a double-layered corner reinforcing structure.

In any or all of the disclosed embodiments, the multilayered corner reinforcing structure comprises a reinforcing panel folded between the first inner side wall panel and the inner back wall panel.

In any or all of the disclosed embodiments, the reinforcing panel abuts an interior of the first corner.

In any or all of the disclosed embodiments, the reinforcing panel comprises a first reinforcing panel portion coupled to the back edge of the first inner side wall panel and a second reinforcing panel portion coupled to the first reinforcing panel portion and to the first side edge of the inner back wall panel. The first and second reinforcing panel portions extend outwardly from the respective first inner side wall panel and the inner back wall panel toward the first corner.

In any or all of the disclosed embodiments, the first reinforcing panel portion has first and second surfaces on opposite sides of the first reinforcing panel portion, the second reinforcing panel portion has first and second surfaces on opposite sides of the second reinforcing panel portion, and the first surface of the first reinforcing panel portion faces the first surface of the second reinforcing panel portion.

In any or all of the disclosed embodiments, the first surface of the first reinforcing panel portion abuts the first surface of the second reinforcing panel portion.

In any or all of the disclosed embodiments, the first and second reinforcing panel portions are coupled together along an interior of the first corner.

In any or all of the disclosed embodiments, the first reinforcing panel portion extends at an angle of 45° from the first corner and the second reinforcing panel portion extends at an angle of 45° from the first corner.

In any or all of the disclosed embodiments, the at least two side walls comprise a first side wall and a second side wall, the first inner side wall panel is part of the first side wall, the second side wall comprises a second inner side wall panel, and the first reinforcing panel portion extends between the inner back wall panel and the first inner side wall panel of the first side wall and couples the inner back wall panel to the first inner side wall panel. The second reinforcing panel portion extends between the inner back wall panel and the second inner side wall panel of the second side wall and couples the inner back wall panel to the second inner side wall panel.

In any or all of the disclosed embodiments, there are at least two back corners of the tray and at least two such multilayer corner reinforcing structures, one multilayer corner reinforcing structure being located at each of such corners.

In any or all of the disclosed embodiments, a first outer side wall panel, and not the first inner side wall panel, has a flap coupled to a front edge of the outer side wall panel, the flap including a portion insertable between first and second front wall panel portions that are folded to form a front wall of the tray.

In any or all of the disclosed embodiments, both a front edge of a first outer side wall panel and the front edge of the first inner side wall panel include flaps projecting outwardly therefrom along the front of the tray, and wherein only the outer of said flaps has a portion which is inserted between first and second front wall panel portions of the tray.

In any or all of the disclosed embodiments, the inner side wall panels each comprise a tab or section that is adhesively secured to a respective bottom-forming panel coupled to a lower edge of the adjacent outer side wall panel.

In any or all of the disclosed embodiments, the bottom-forming panels each comprise a tuck portion inserted below the bottom edge of the inner back wall panel and into the gap between the inner and outer back wall panels.

In any or all of the disclosed embodiments, the inner back wall panel comprises a tab or section that is adhesively secured to a bottom-forming panel that is coupled to a lower edge of the outer back wall panel.

In another representative embodiment, a tray comprises a back wall, at least two side walls, a front wall, and a bottom. The side walls each comprise an inner side wall panel and an outer side wall panel, a gap being provided between the inner and outer side wall panels. The back wall comprises an outer back wall panel and an inner back wall panel, a gap being provided between the inner back wall panel and the outer back wall panel. The inner back wall panel comprises first and second side edges, a top edge, and a bottom edge. A first of the inner side wall panels comprises a back edge, a front edge, a top edge, and a bottom edge. A corner reinforcing structure couples the back edge of the first inner side wall panel to the first side edge of the inner back wall panel at a first corner of the tray. The corner reinforcing structure comprises a first reinforcing panel portion coupled to the back edge of the first inner side wall panel, a second reinforcing panel portion coupled to the first reinforcing panel portion and to first side edge of the inner back wall panel, the first and second reinforcing panel portions extending outwardly from the respective first inner side wall panel and the inner back wall panel toward the first corner.

In any or all of the disclosed embodiments, the first reinforcing panel portion has first and second surfaces on opposite sides of the first reinforcing panel portion, the second reinforcing panel portion has first and second surfaces on opposite sides of the second reinforcing panel portion, and the first surface of the first reinforcing panel portion faces the first surface of the second reinforcing panel portion.

In any or all of the disclosed embodiments, the first surface of the first reinforcing panel portion abuts the first surface of the second reinforcing panel portion.

In any or all of the disclosed embodiments, the first and second reinforcing panel portions abut the interior of the first corner.

In another representative embodiment, a tray comprises a back wall, first and second side walls, a front wall, and a bottom. The first and second side walls each comprise an inner side wall panel and an outer side wall panel with a gap between the inner and outer side wall panels. The back wall comprises an outer back wall panel and an inner back wall panel, a gap being provided between the inner back wall panel and the outer back wall panel. The inner back wall panel comprises first and second side edges, the inner side wall panel of the first side wall comprises a back edge and a front edge, and the inner side wall panel of the second side wall comprising a back edge and a front edge. The inner back wall panel is coupled to the inner side wall panel of the first side wall by a first reinforcing panel extending between the inner back wall panel and the inner side wall panel of the first side wall, and the inner back wall panel is coupled to the inner side wall panel of the second side wall by a second reinforcing panel extending between the inner back wall panel and the inner side wall panel of the second side wall.

In another representative embodiment, a tray comprises a back wall, first and second side walls, a front wall, and a bottom. The first and second side walls each comprise an inner side wall panel and an outer side wall panel with a gap between the inner and outer side wall panels. The back wall comprises an outer back wall panel and an inner back wall panel, a gap being provided between the inner back wall panel and the outer back wall panel. The inner back wall panel comprises first and second side edges. The inner side wall panel of the first side wall comprises a back edge and a front edge. The inner side wall panel of the second side wall comprises a back edge and a front edge. A first multilayered corner reinforcing structure couples the back edge of the inner side wall panel of the first wall to the first side edge of the inner back wall panel at a first corner of the tray, and a second multilayered corner reinforcing structure couples the back edge of the inner side wall panel of the second side wall to the second side edge of the inner back wall panel at a second corner of the tray.

The foregoing and other objects, features, and advantages of the disclosed technology will become more apparent from the following detailed description, which proceeds with reference to the accompanying figures.

DETAILED DESCRIPTION

Figure 1:
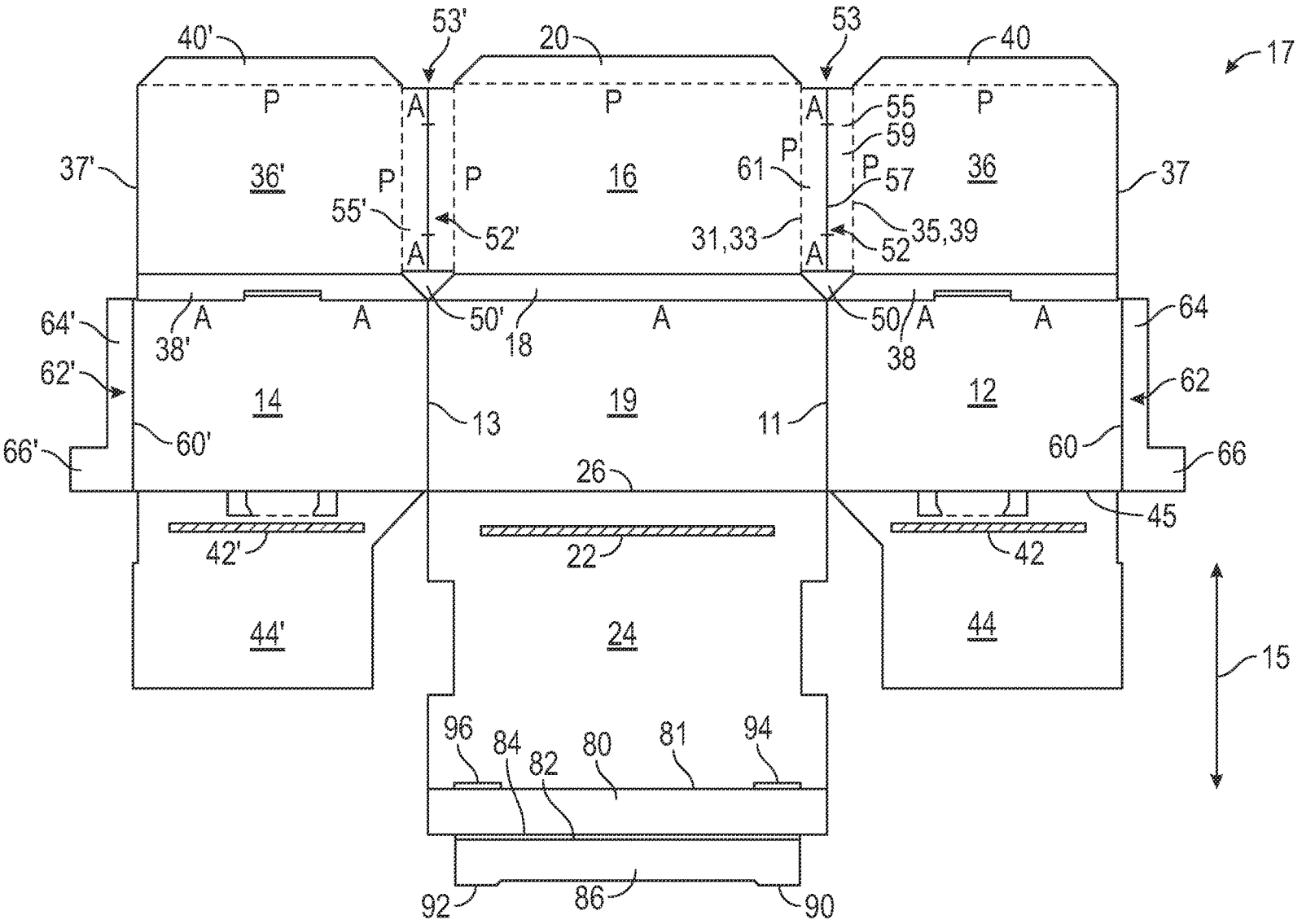
FIG. 1 illustrates a blank of paperboard for use in forming a tray in accordance with a first embodiment of the disclosure.

The trays/containers/bins of the embodiments disclosed herein, referred to hereinafter as trays, can be formed from a single piece, or unitary integrated, paperboard blank. The blank can be corrugated paperboard comprising at least one corrugated layer between paper sheets. For increased vertical stacking strength, the corrugations of the portions of the blank that form side walls and a back wall of the tray are desirably configured to extend in an upright, and more desirably a vertical direction, from the bottom of the tray in the assembled tray.

Trays in accordance with this disclosure can comprise cellular side walls and a cellular back wall. That is, as explained below, the side walls can each comprise an outer side wall panel and an inner side wall panel. The inner and outer side wall panels are opposed to one another and are spaced apart to provide a gap or cell therebetween. Desirably the inner and outer side wall panels are parallel to one another and are upright, and most desirably vertical, extending upwardly from the tray bottom, of the finished tray. In addition, the tray back wall also desirably comprises an outer back wall panel and an inner back wall panel. The inner and outer back wall panels are opposed to one another and are spaced apart to provide a gap or cell therebetween. Desirably the inner and outer back wall panels are parallel to one another and are upright, and most desirably vertical, extending upwardly from the tray bottom, of the finished tray.

A rear/back side edge of the outer side wall panel of the first side wall can be coupled to a first side edge of the outer rear wall panel at a first outer tray corner. A rear side edge of the outer side wall panel of the second side wall can be coupled to a second side edge of the outer rear wall panel at a second outer tray corner. A first inner corner reinforcing panel structure can couple a rear side edge of an inner side wall panel of the first wall to a first side edge of the inner back wall panel. A second inner corner reinforcing panel structure can couple a rear side edge of an inner side wall panel of the second side wall to a second side edge of the inner back wall panel. In the constructed trays, the corner reinforcing structures can provide a plurality of multilayered, upright walls at the rear corners of the trays and can enhance the vertical strength of such corners.

For example, in certain embodiments the corner reinforcing structures can comprise reinforcing panels folded into two, three, four, five panel sections, or more. In certain embodiments, the reinforcing panel sections can be folded over alternatingly in the manner of a fan or a bellows. These upright, multilayered wall structures can be received in the outer corners formed by the outer side wall panels and the outer back wall panel, and can extend diagonally, or at some other angle, away from the adjacent outer corners of the tray (e.g., toward the interior of the tray). In certain embodiments, the reinforcing corner structures described herein can provide added strength to the corners in, for example, the direction of the flutes/corrugations of the paperboard. This can allow multiple trays loaded with product to be stacked on top of one another without buckling at the corners.

These corner reinforcing structures, by coupling the inner side wall panels and inner back wall panel together, can also facilitate the assembly of the container. For example, the corner reinforcing structures and the inner panels of the first and second side walls and the back wall can be folded over together to overlay the respective outer side wall panels and outer back wall panel without having to account for separated inner side wall and back wall panels. It should be noted that the same corner reinforcing structures can be provided at other corners of a tray or container, such as at the front corners of a tray. However, in the illustrated exemplary embodiments, a different corner structure is provided at the front corners of the tray.

First Representative Embodiment

Figure 6:
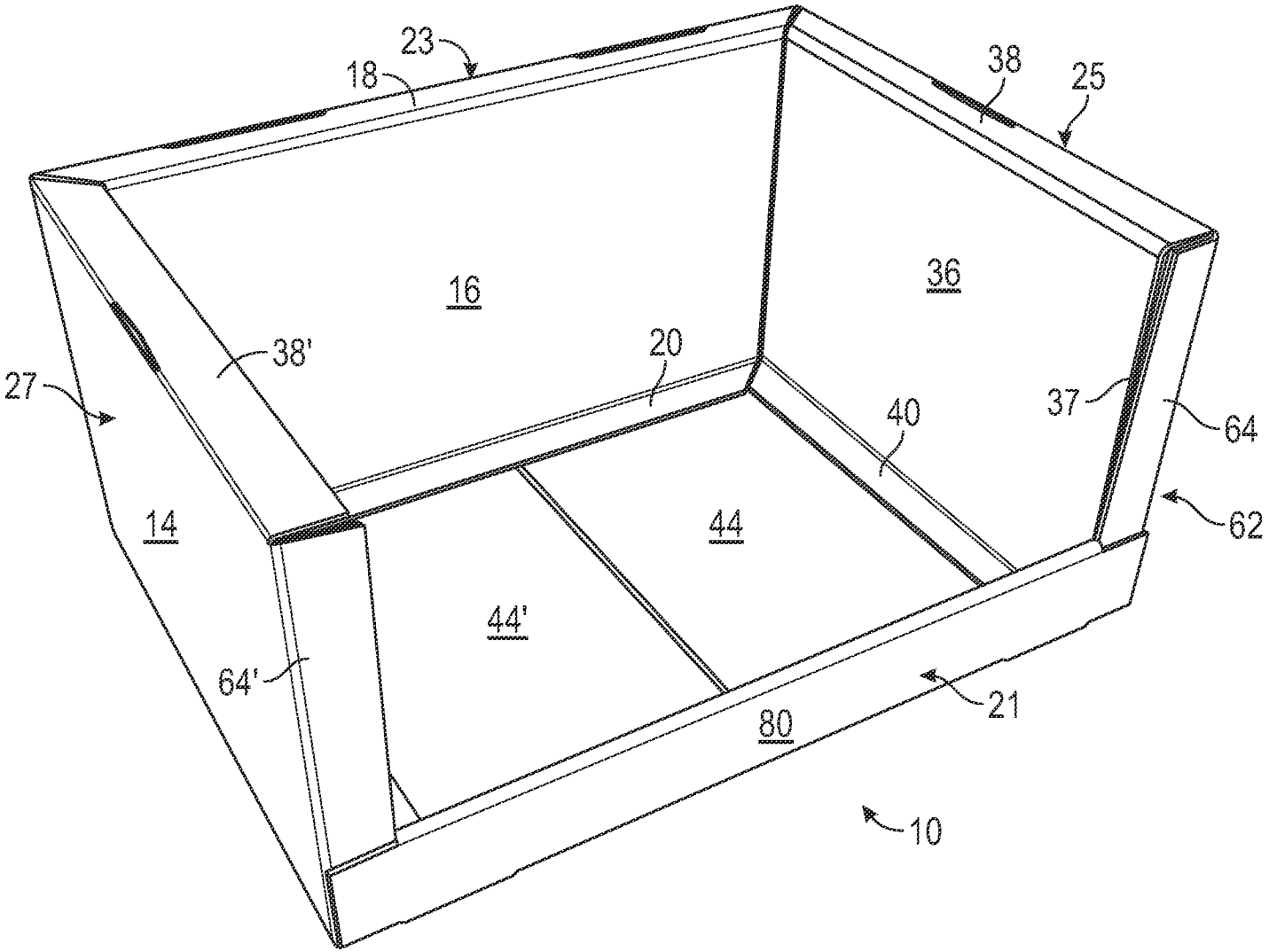
FIG. 6 is a perspective view of an assembled tray formed from the blank of FIG. 1.
Figure 7:
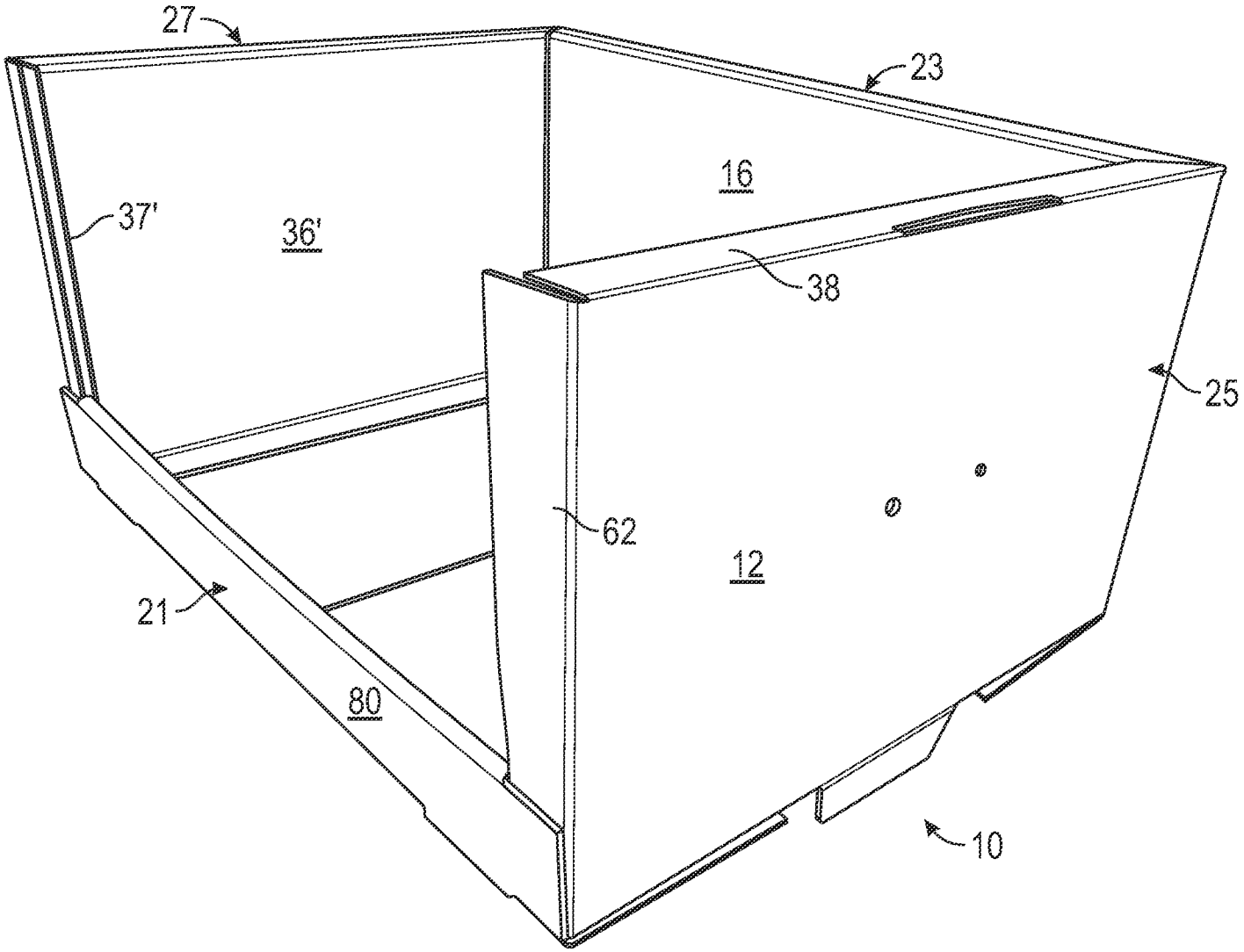
FIG. 7 is another perspective view of the assembled tray of FIG. 6.

An exemplary tray 10 in accordance with a first embodiment of this disclosure is shown in FIGS. 6 and 7. The tray 10 can comprise a front wall 21, a back or rear wall 23, and first and second side walls 25 (e.g., right) and 27 (e.g., left). The front wall 21 can be lower than the back wall 23 to facilitate display of the contents of the tray to customers, for example.

The tray 10 can be formed from the single piece blank 17 shown in FIG. 1. Any dimensions shown in the drawings are exemplary and can be changed as desired. Also, the spacing between inner and outer wall panels can be varied by changing the width of top panel sections between the inner and outer wall panels and the location at which lower edges of the inner wall panels are secured to respective bottom panels.

In the design of FIG. 1, the components of the blank of FIG. 1 that end up in the erected tray design are described below. The numbers included in FIGS. 2-6 for corresponding elements of FIG. 1 are the same. Not all of the numbers are included in FIGS. 2-6 for convenience. In addition, the same numbers are used in the blanks of FIGS. 8 and 14 for those components in these blanks (and in FIGS. 9-13 and FIGS. 15-18 to the extent that numbers are included in these figures) that are the same as the components of FIG. 1. In discussing the embodiments of FIGS. 9-13 and 14-18 below, in general, only the differences between these embodiments and the embodiment of FIGS. 1-7 will be described.

Referring to FIG. 1, the blank comprises components described below.

The illustrated tray comprises an outer back wall panel 19, an outer first or right-side wall panel 12, and an outer second or left-side wall panel 14. Respective right-angled outer box corners 11, 13 are present between panels 19 and 12, and between panels 19 and 14.

An inner back wall panel 16 is provided with an outer wall spacer panel section 18 between the inner back wall panel 16 and the outer back wall panel 19 that couples these two outer wall panel sections together. When assembled, a glue flap 20 extending outwardly from the upper edge of the inner back wall panel 16 ends up secured, such as by a glue line 22, to an interior surface of a bottom panel 24. The bottom panel 24 desirably is coupled to and extends from the lower edge 26 of the outer back panel 19. The glue line 22 can be spaced inwardly from the edge 26 so that a gap exists between the outer back wall panel 19 and the glue line. This gap can be adjusted together with the width of the panel section 18 such that a gap or cell is provided between the outer and inner back wall panels 19 and 16 when erected to form the back wall 23. In certain embodiments, these panels 19, 16 can be parallel or substantially parallel to one another, spaced apart, and vertical or substantially vertical in the assembled tray. The fold line between the glue flap 20 and the inner back wall panel 16 can be the lower/bottom edge of the inner back wall panel 16 in the assembled tray. The fold line between the panel section 18 and the inner back wall panel 16 can be the upper/top edge of the inner back wall panel 16 in the assembled tray.

The illustrated tray also comprises an inner first or right-side inner wall panel 36. A first side wall spacer panel section 38 can be provided between the first inner wall panel 36 and the first outer wall panel 12 and couples the panel sections 12, 36 together. When assembled, the fold line between the panel 36 and the spacer panel section 38 can be the top edge of the inner side wall panel 36. When assembled, a glue flap 40, extending outwardly from the upper edge (e.g., a bottom edge of the panel in the erected tray) of the inner side wall panel 36 ends up secured, such as by a glue line 42, to an interior surface of a bottom-forming panel 44. The bottom-forming panel 44 can be coupled to and extend from a lower edge 45 of the outer side wall panel 12. The glue line 42 can be spaced inwardly from the edge 45 so that a gap exists between the outer side wall panel 12 and the glue line. This gap can be adjusted together with the width of the panel section 38 such that a gap or cell is provided between the outer and inner side wall panels 12 and 36 when erected to form the first side wall 25. In certain embodiments, the panels 12, 36 can be parallel or substantially parallel to one another, spaced apart, and vertical or substantially vertical in the assembled tray.

In the assembled container the bottom-forming panel flap 44 desirably overlays at least a portion of the bottom panel 24.

A cutout 50 can be provided between spacer panels 18 and 38. The cutout 50 can be triangular with an apex of the triangle intersecting the edge 11 between the outer panels 19 and 12. In addition, a second cutout 53 can be provided between glue tabs or sections 20, 40. This second cutout 53 can be trapezoidal. These cutouts can facilitate folding of the inner wall panels such that adjacent side edges of the inner wall panels 16 and 36 are adjacent to, and can abut, one another in the assembled container.

An exemplary corner forming or corner reinforcing structure between inner back wall panel 16 and inner side wall panel 36 is indicated generally at 52 in FIG. 1. Although the corner reinforcing structure can take other shapes, the illustrated corner reinforcing structure can comprise a rectangular reinforcing panel/panel section 55. The reinforcing panel 55 can comprise a first side edge 31 foldably coupled, such as by a weakened line that can comprise perforations, to the adjacent side edge (e.g., a first side edge) 33 of the inner back panel 16. The reinforcing panel 55 can further comprise a second side edge 35 foldably coupled to, such as by a weakened line that can comprise perforations, the adjacent side edge (e.g., a back edge) 39 of the inner side wall panel 36. Although not required, for enhanced vertical stacking strength, the height of the reinforcing panel 55 can be equal or substantially equal to the length of the side edges 33, 39. A weakened line 57, such as a score line extending part way between upper and lower ends of the reinforcing panel 55 defines first and second reinforcing panel portions 59, 61, on opposite sides of the line 57. The line 57 can be on a line bisecting the reinforcing panel 55 in a lengthwise direction such that the widths of the reinforcing panel portions 59, 61 are the same or substantially the same. In certain embodiments, when the container is erected, the adjacent side edges of the panel portions 59, 61 end up adjacent to or abutting the inner side of the tray corner 11.

Figure 4:
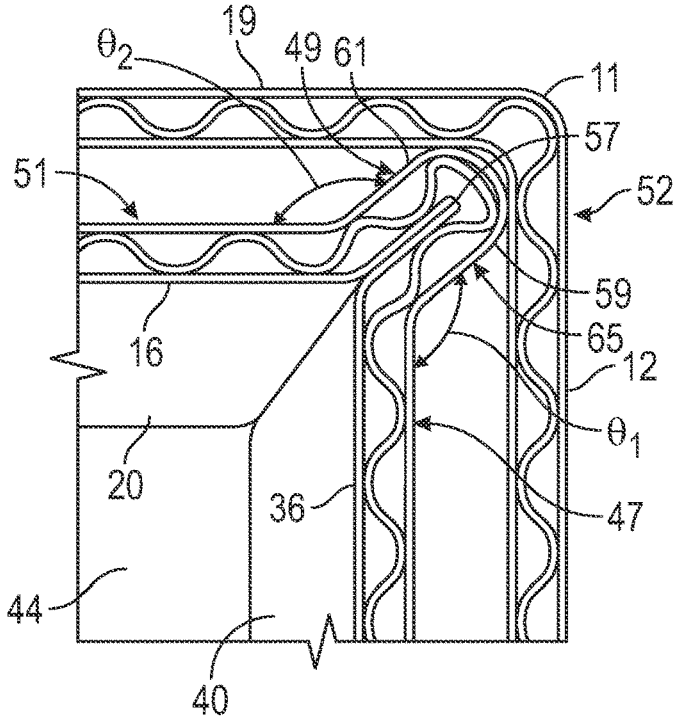
FIG. 4 is a cross-sectional view of a portion of one of the rear corners of the tray of FIG. 3.

The exemplary assembled corner is best seen in FIG. 4. As shown in FIG. 4, the reinforcing panel 55 folds along the weakened line 57 to form a multilayered, upright wall or corner reinforcing structure in which the reinforcing panel portions 59, 61 form the layers of the structure. Thus, in the illustrated embodiment the corner reinforcing structure is a double-layered corner reinforcing structure, although in other embodiments the corner reinforcing structure can have three layers, four layers, etc., by dividing the reinforcing panel 55 into a corresponding number of panel portions. In certain embodiments, the reinforcing panel portions can fold alternatingly backwards and forwards in the manner of a fan or a bellows.

In addition, the respective interior surfaces of the reinforcing panel portions 59 and 61 are shown abutting one another with side edges of the reinforcing panel portions abutting the interior of the corner 11. For example, with reference to FIGS. 2 and 4, the interior (e.g., first) surfaces 41 and 43 of the panel portions 59 and 61, respectively, can be opposed, facing, or in contact with/abut one another in the assembled state. The edge portions of the panel portions 59 and 61 adjacent the line 57 (e.g., on opposite sides of the line 57) can be received in and/or contact the interior of the corner 11 formed by the outer back wall panel 19 and the outer side wall panel 12.

As can be seen in FIG. 4, there is an included angle θ1 between the exterior (e.g., second) surface 65 of the reinforcing panel portion 59 and the interior surface 47 of the inner side wall panel 36. There can also be an included angle θ2 between the exterior (e.g., second) surface 49 of the reinforcing panel portion 61 and the interior surface 51 of the inner back wall panel 16. These angles can be the same or different depending on the width of the reinforcing panel portions relative to the with of the gaps between the inner and outer wall panels. In the example shown in FIG. 4, the angles $\theta_1$ and $\theta_2$ are the same and are equal to 135°, but can be from 90° to 180° depending upon the particular requirements of the tray. With vertically oriented corrugations, the corner 11 has exceptional vertical stacking strength due to the 90° angled corner portion 11 formed by the outer panels 19, 12 in combination with the reinforcing panel portions 59, 61 that are received in the corner 11 and extend away from the corner 11 at a 45° angle relative to the outer panels 12, 19 toward the interior of the tray.

Referring again to FIG. 1, the front side edge 60 of the right-side outer panel 12, which forms a right-side front corner of the erected tray, has an L-shaped right-side flap 62 foldably attached thereto. The L-shaped flap 62 has an upright portion 64 along the side edge 60 and a front wall engaging projecting portion 66. Although a similar flap can be attached to the outer edge of the inner right-side wall panel section, in the tray made from the blank of FIG. 1, the outer edge 37 (e.g., front edge) of the inner right-side wall panel 36 has no flaps attached thereto.

The left-side tray components are mirror images of the right-side tray components. For convenience, each of the left-side components is given the same number plus a prime (') designation as the number of the corresponding right-side component and will not be discussed further. Accordingly, the corner 13 can comprise a multilayer corner reinforcing structure formed by the reinforcing panel 55' similar to the reinforcing structure of the corner 11.

The front of the tray is formed by a first outer front panel portion/section 80 coupled to the front edge of the bottom panel 24 by a fold line 81 and by a second inner front panel portion/section 86 joined to the front panel portion 80 by a pair of spaced apart fold lines 82, 84. Optional projecting tabs 90, 92 of front panel portion 86 can be inserted into respective slots 94, 96 when the front wall 21 of the tray is assembled. The projecting portion 66 of the right-side flap 62 is inserted between the front panel portions 80, 86 in the assembled tray.

With reference to FIG. 1 the direction of the corrugations in this embodiment is indicated at 15. With this orientation, in the erected tray, the corrugations of inner and outer side wall panels and the inner and outer back wall panels, as well as the upright sections of the corner reinforcing structures are desirably vertical when the bottom of the tray is horizontally positioned.

The various panel sections that fold relative to one another desirably are joined together by weakened lines. The weakened lines can be formed such as by creases, perforations, combinations of slits separated by lands and/or score lines. In FIG. 1, as one specific example, weakened lines formed by perforations are indicated by P and shown in dashed lines, and score lines are indicated by A. In addition, fold lines between panels formed by, for example, creases are indicated by solid lines between the panels.

Figure 2:
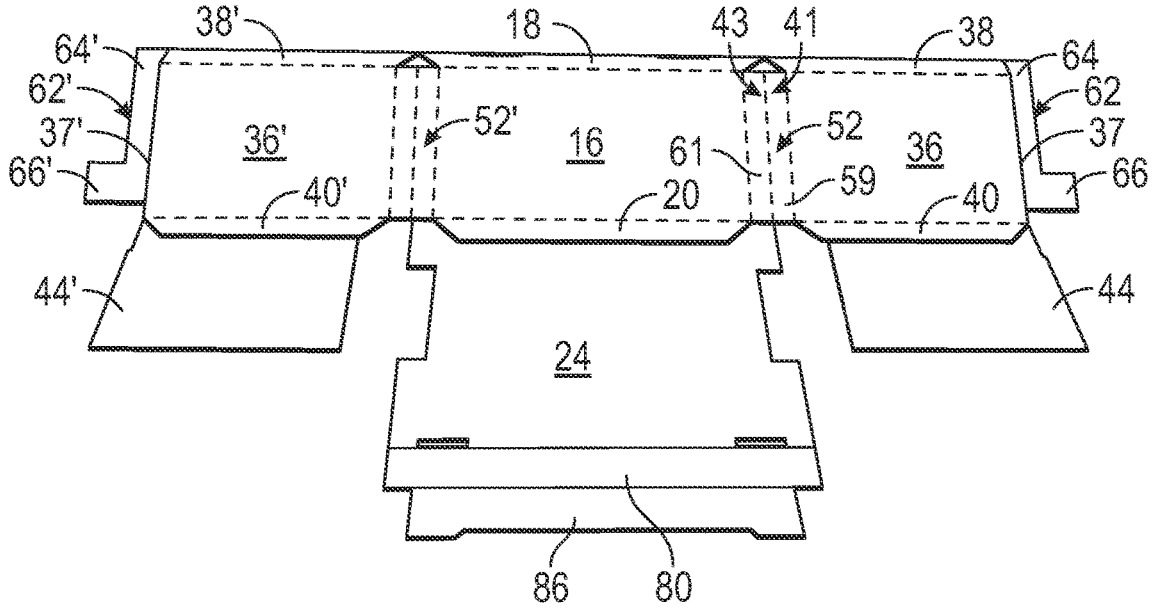
FIG. 2 illustrates the blank of FIG. 1, partially assembled into a tray, with inner side wall panels folded against outer side wall panels and an inner back wall panel folded against an outer back wall panel.

FIGS. 2, 3, 5, and 6 illustrate a representative method of erecting the tray 10. FIG. 2 illustrates the blank 17 with the inner back wall panel 16 and the inner side wall panels 36 and 36' folded over onto the outer back wall panel 19 and the outer side wall panels 12 and 14, respectively. Because the inner side wall panel 36 and the inner side wall panel 36' are coupled to the inner back wall panel 16 by the reinforcing panels 55 and 55', respectively, each of the panels 16, 36, and 36' can advantageously be folded over in a single step.

Figure 3:
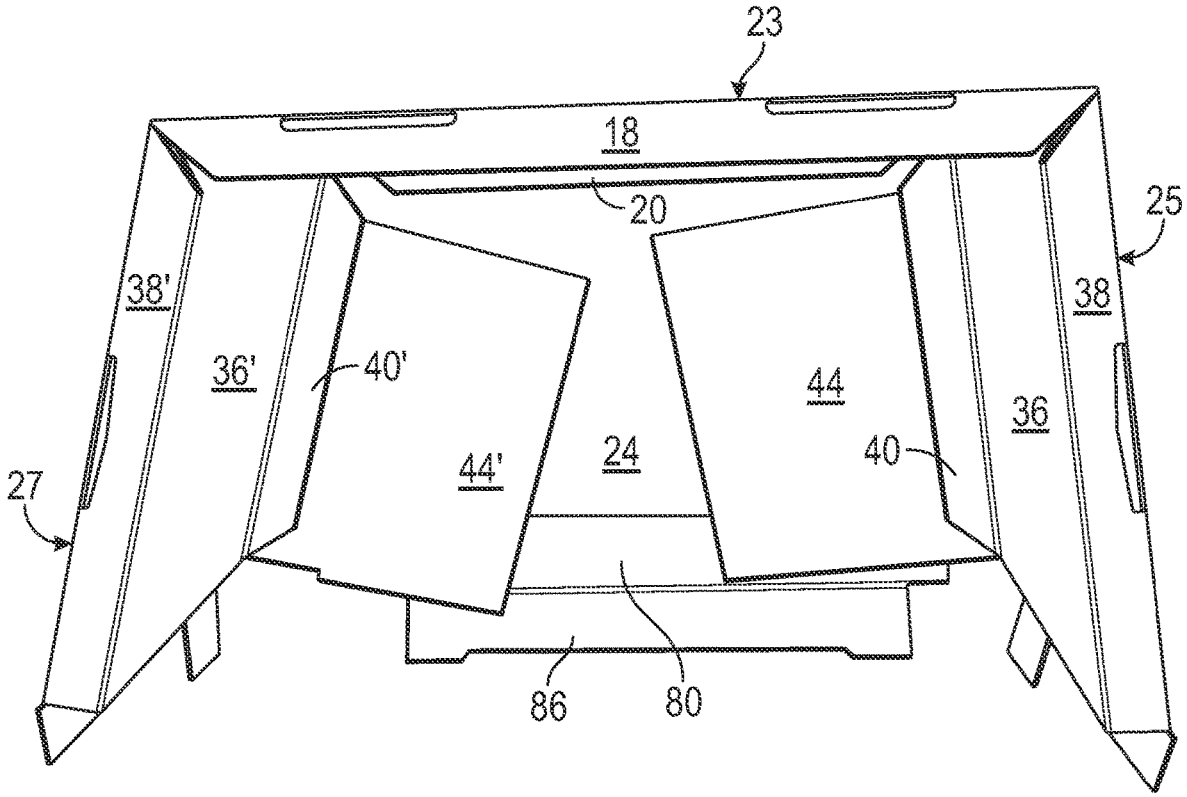
FIG. 3 illustrates the tray of FIG. 2 in a further assembled state with the side walls and a back wall in an upright position and with portions of side bottom panels, extending from a lower edge of the outer side wall panels overlaying a back bottom panel extending from a lower edge of the outer back wall panel.
Figure 5:
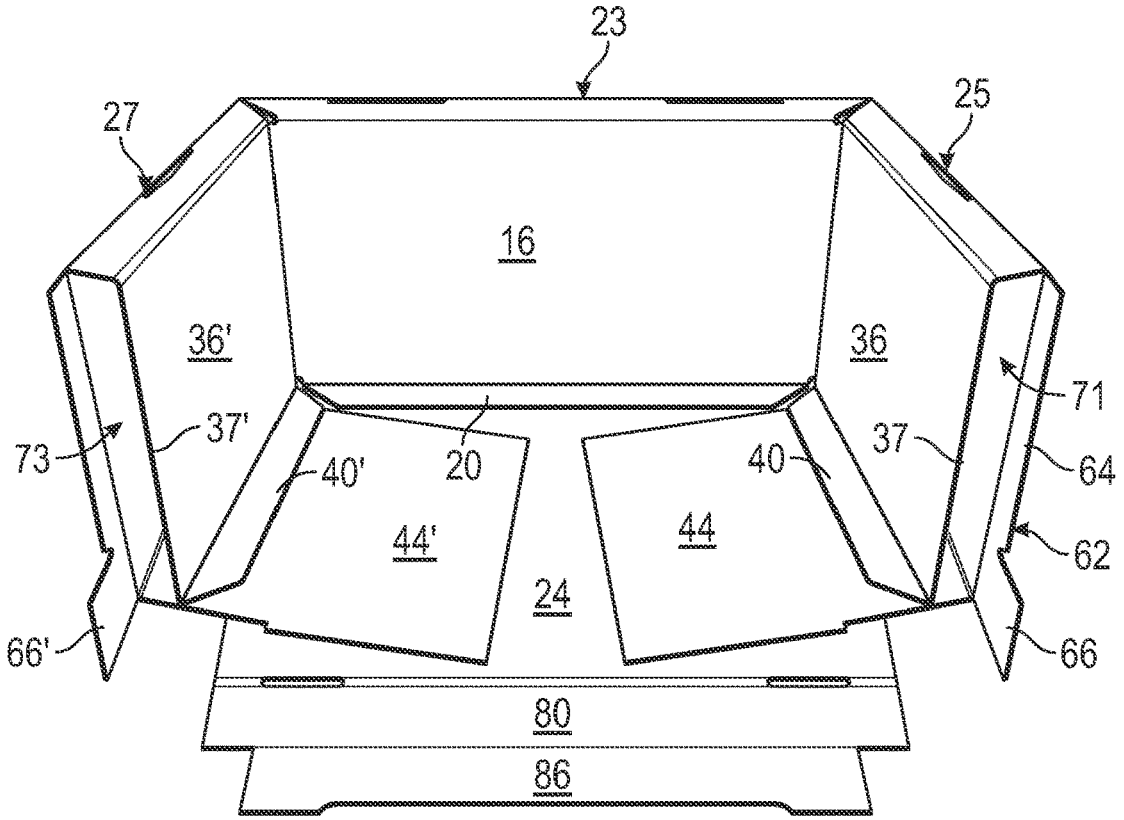
FIG. 5 is a front view of the partially assembled tray of FIG. 3.

FIGS. 3 and 5 illustrate the inner and outer back wall panels 16 and 19 erected to form the cellular back wall 23, the inner and outer right side panels 36 and 12 erected to form the cellular right side wall 25, and the inner and outer left side panels 14 and 36' erected to form the cellular left side wall 27. FIG. 5 illustrates a cell/gap/volume 71 enclosed between the inner and outer right side wall panels 36 and 12, and a cell/gap/volume 73 enclosed between the inner and outer left side wall panels 36' and 14. The flap 20 can be secured (e.g., by glue or adhesive) in place on the bottom panel 24, and the flaps 40 and 40' can be secured to the left and right bottom-forming flaps 44, 44', respectively.

In FIGS. 6 and 7, the front panel portions 80 and 86 can also be erected, and the tabs 90 and 92 of the front panel portion 86 can be inserted into the corresponding openings 94 and 96 of the bottom panel 24 (FIG. 1) to form the front wall. The L-shaped flap 62 can also be folded inwardly so that the projecting portion 66 is received in between the front wall panels 80 and 86, and such that the upright portion 64 encloses the cellular space between the inner and outer wall panels 36, 12. The L-shaped flap 62' can be folded and engaged in a similar manner with the front wall panels. In certain embodiments, because only the portions 66 and 66' of the L-shaped flaps 62 and 62' are received between the panels 80 and 86 of the front wall 21, the panel 86 does not bulge inwardly into the tray area when the front wall 21 is assembled. Thus, the inner surface of the panel 86 can be straight or substantially straight, and the tray can snugly/tightly receive product(s) between the four straight walls, reducing undesirable movement/abrasion of product(s). Stated differently, the panel 86 can form a corner with each of the inner wall panels 36 and 36', resulting in a rectangular interior tray area and avoiding a bowed/curved panel 86.

Second Representative Embodiment

The embodiment of FIGS. 8-13 is the same as the embodiment of FIGS. 1-7 except that a rectangular side flap 110 is foldably attached to the edge 37 of the inner side wall panel 36 (and a flap 110' is foldably attached to the side edge 37' of the other inner side wall panel 36'). The side flap 110 has no portions that are inserted between the front wall forming panel sections 80, 86. The combination of the inner side flap 110 and the outer side flap 62 adds vertical strength to the front corner of the tray. In the FIG. 8 embodiment, glue is applied to the glue flaps instead of to portions of the bottom panel, although either approach can be used in the various embodiments.

Figure 8:
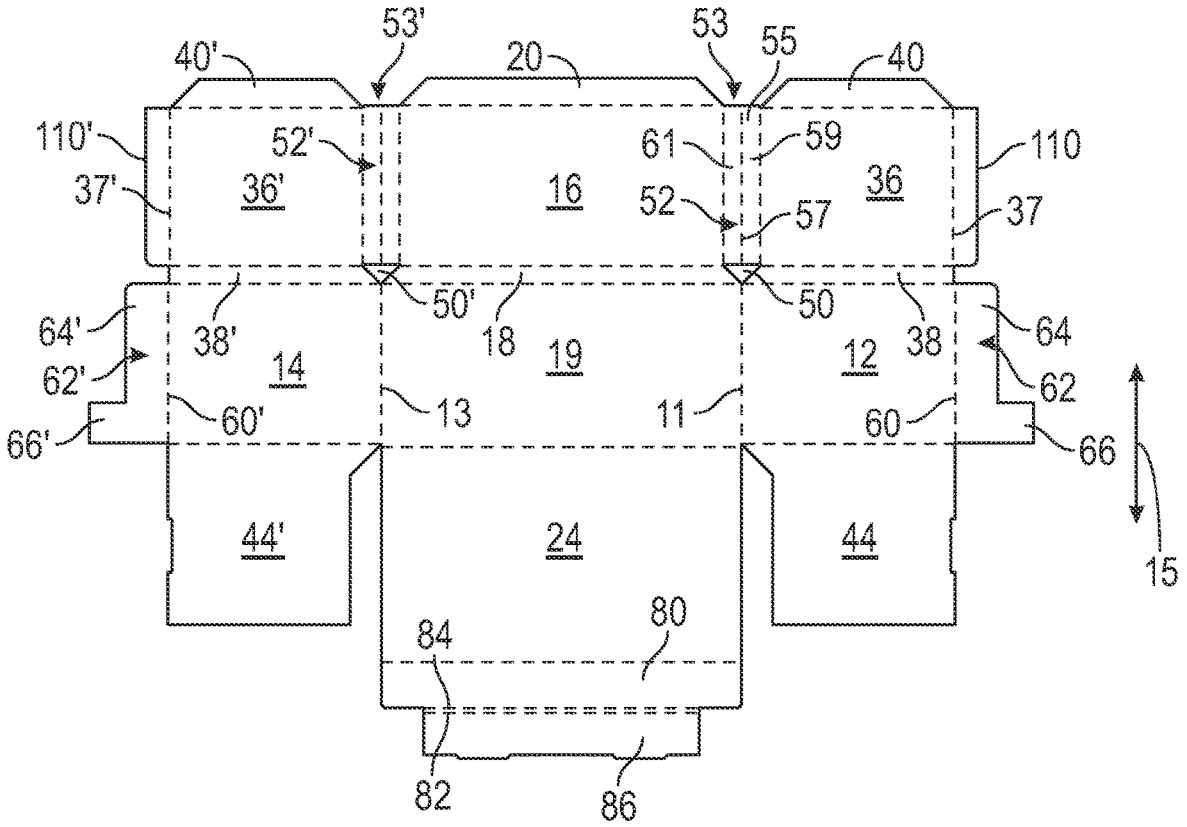
FIG. 8 illustrates a paperboard blank used in assembling a second embodiment of a tray in accordance with this disclosure.
Figure 9:
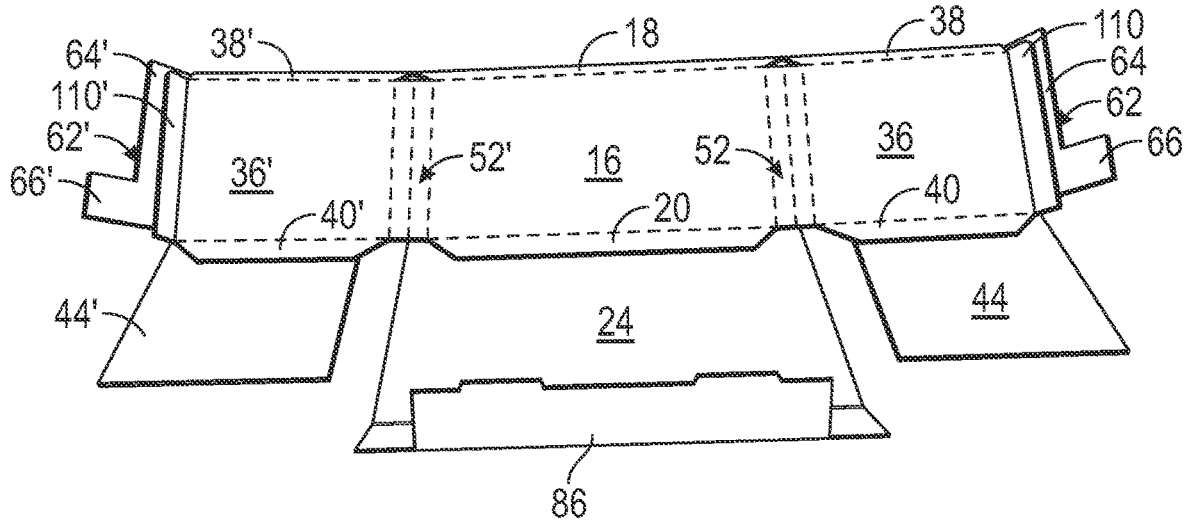
FIG. 9 is a view of the blank of FIG. 8 with inner side and inner rear panel sections folded to overlay respective outer side panel sections and an outer rear panel section.
Figure 10:
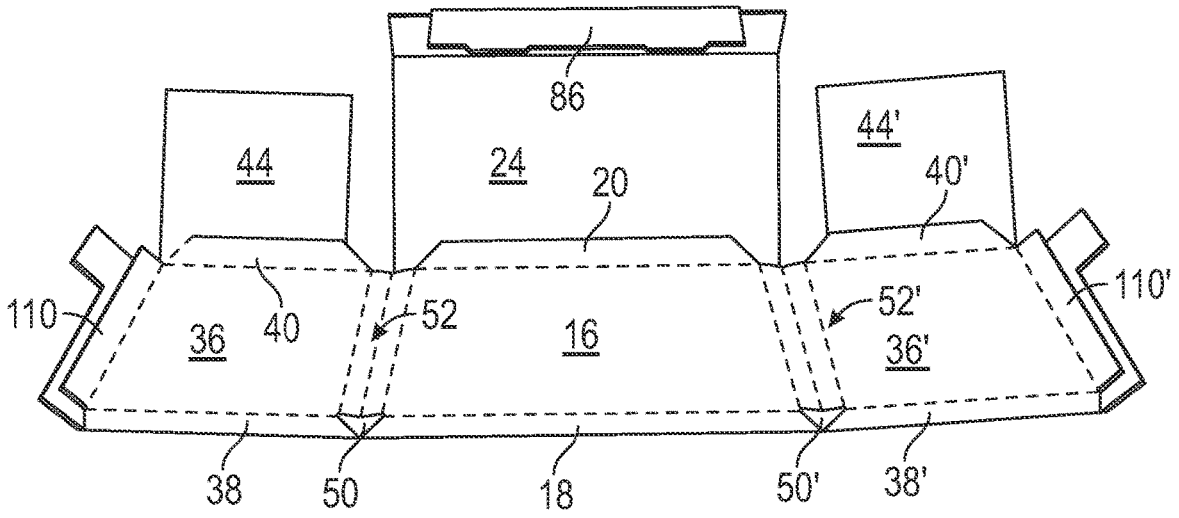
FIG. 10 is a view taken from the opposite direction of FIG. 9 with bottom-forming panel sections shown folded into an upright position.
Figure 11:
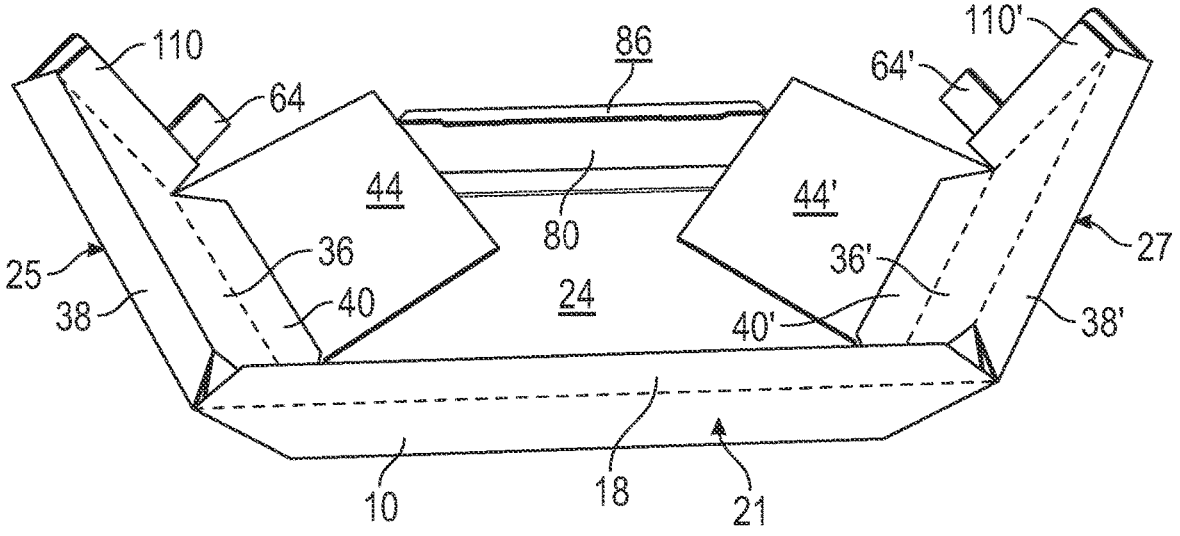
FIG. 11 illustrates the tray of this second embodiment in a further assembled condition with the side walls and back wall shown in an upright orientation.
Figure 12:
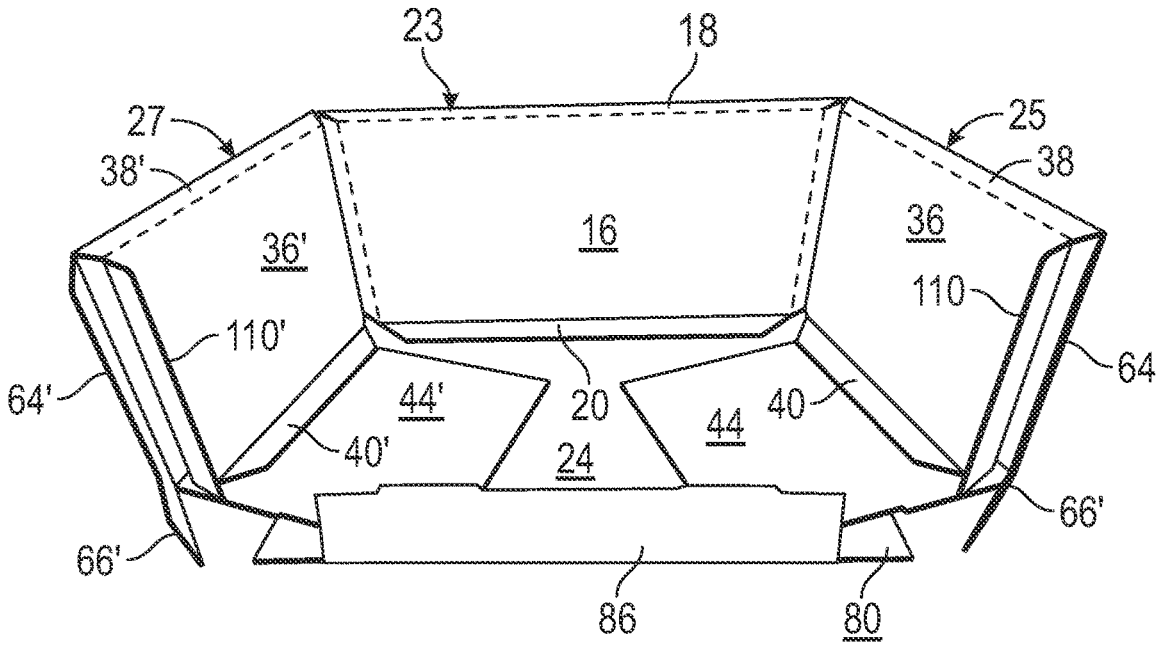
FIG. 12 is another view of the tray substantially in the state shown in FIG. 11.
Figure 13:
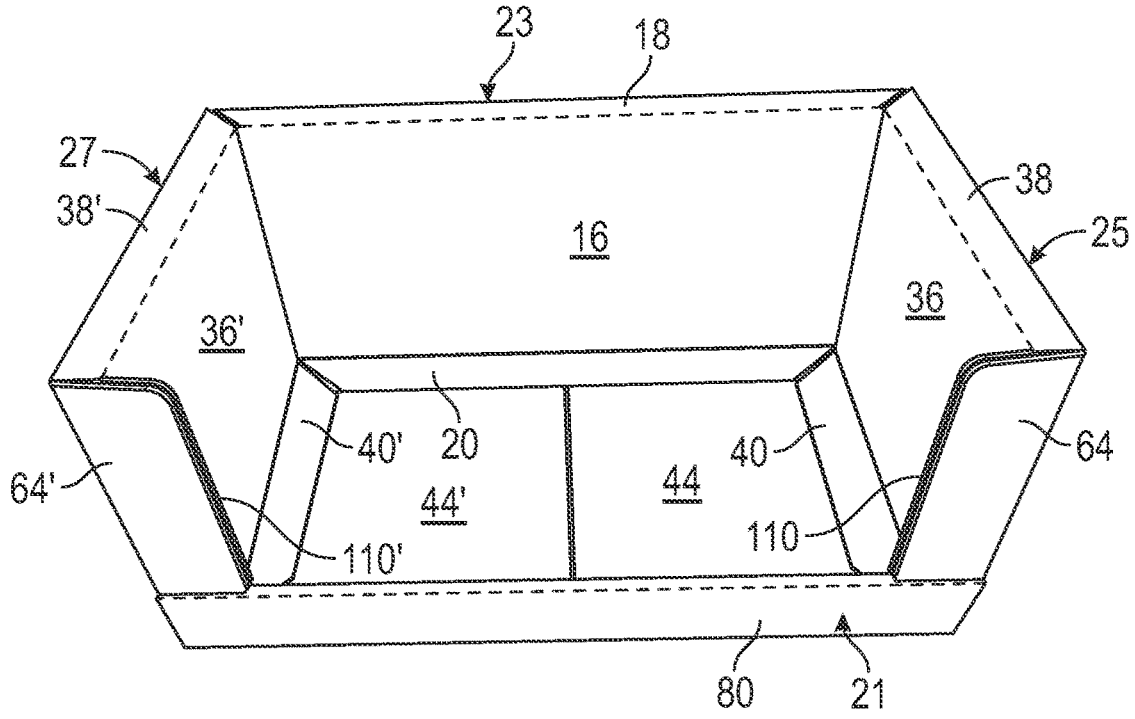
FIG. 13 illustrates a completed tray assembled from the blank of FIG. 8.
Figure 14:
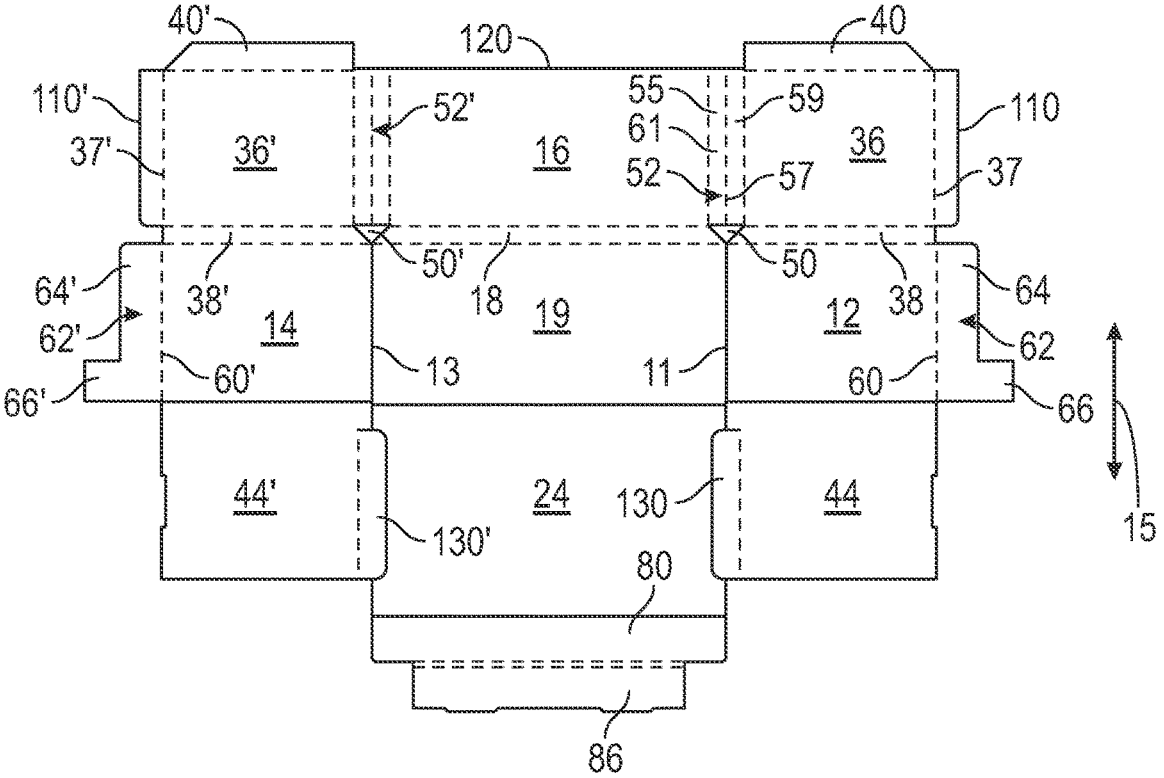
FIG. 14 illustrates a paperboard blank for forming a third embodiment of a tray in accordance with this disclosure.

FIGS. 9-13 illustrate assembly of the tray of FIG. 8. FIG. 9 illustrates the inner side wall panels and the inner back wall panel folded over onto the outer side wall panels and the outer back wall panel. As in the embodiment of FIG. 1, the inner side wall panels and the inner back wall panel are coupled together by the corner reinforcing structures 52, 52' comprising the reinforcing panels 55 and 55'. In FIG. 10, the bottom panel 24 and the flaps 44 and 44' are folded up, and in FIGS. 11 and 12 the side walls 25 and 27 can be folded or swung inwardly so that the panels 44 and 44' are positioned to overlay the bottom panel 24. The gaps formed between the inner and outer panels of the side walls can be seen in FIG. 12. The fully assembled tray is illustrated in FIG. 13 with the panels 64 and 110 and the panels 64' and 110' forming respective double-layered vertical wall structures on either side of the front wall 21.

Additionally, when the front wall 21 is assembled, the panel 86 can abut the panels 110 and 110'. In certain embodiments, the panel 86 can abut the edges of the panels 110 and 110' such that the panel 86 is coplanar with the panels 110 and 110'. Thus, the panel 86 can form a corner with each of the panels 110 and 110'. As noted above, because only the portions 66 and 66' of the L-shaped flaps 62 and 62' are received between the panels 80 and 86 of the front wall 21, the panel 86 does not bulge inwardly into the tray area, and the tray can snugly/tightly receive product(s) between four straight walls.

Third Representative Embodiment

Figure 15:
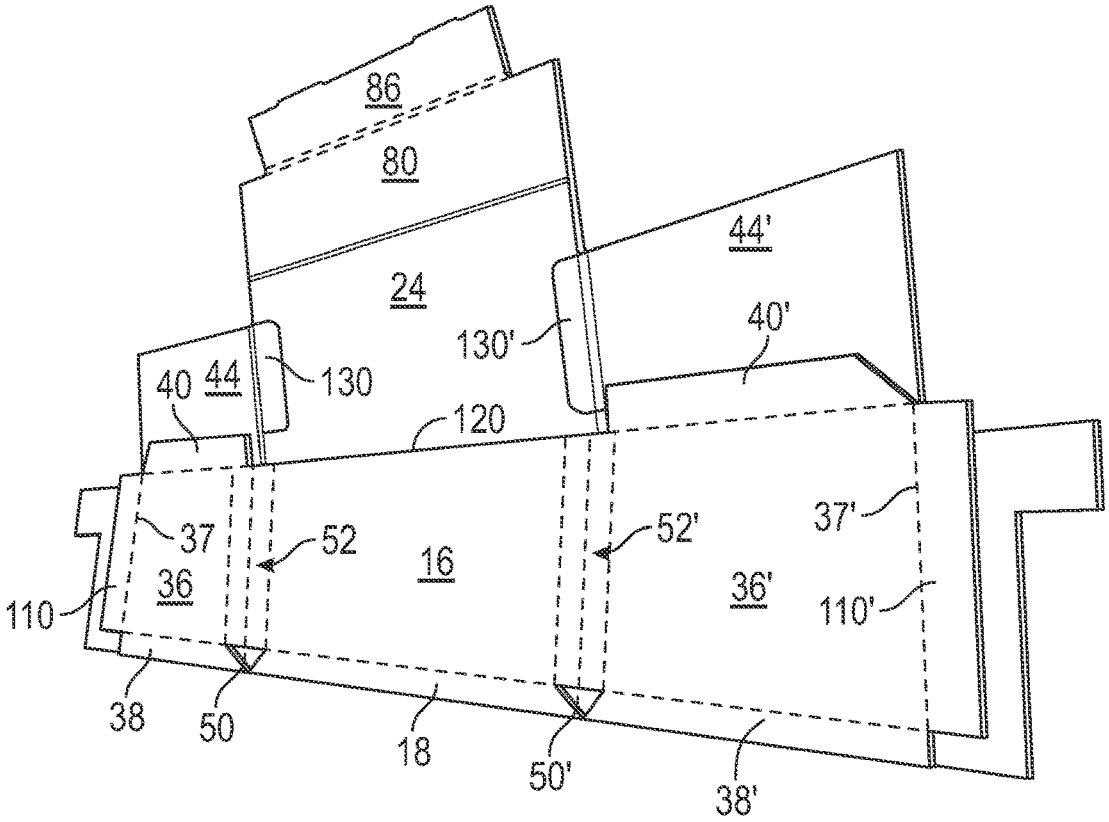
FIG. 15 illustrates the blank of FIG. 14 in a partially assembled condition with inner side wall panels and a back wall panel folded to overlay respective outer side wall panels and an outer back wall panel.
Figure 16:
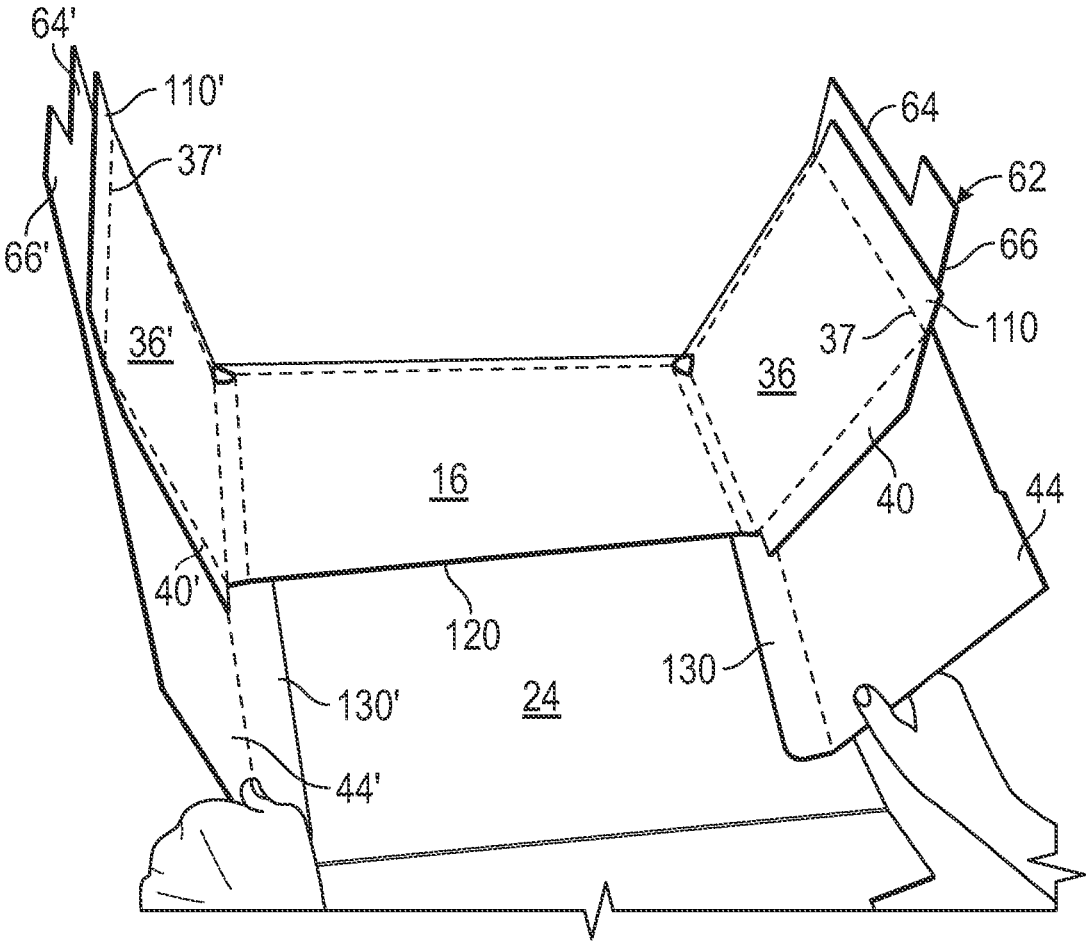
FIG. 16 illustrates the tray of this embodiment in a further state of assembly.
Figure 17:
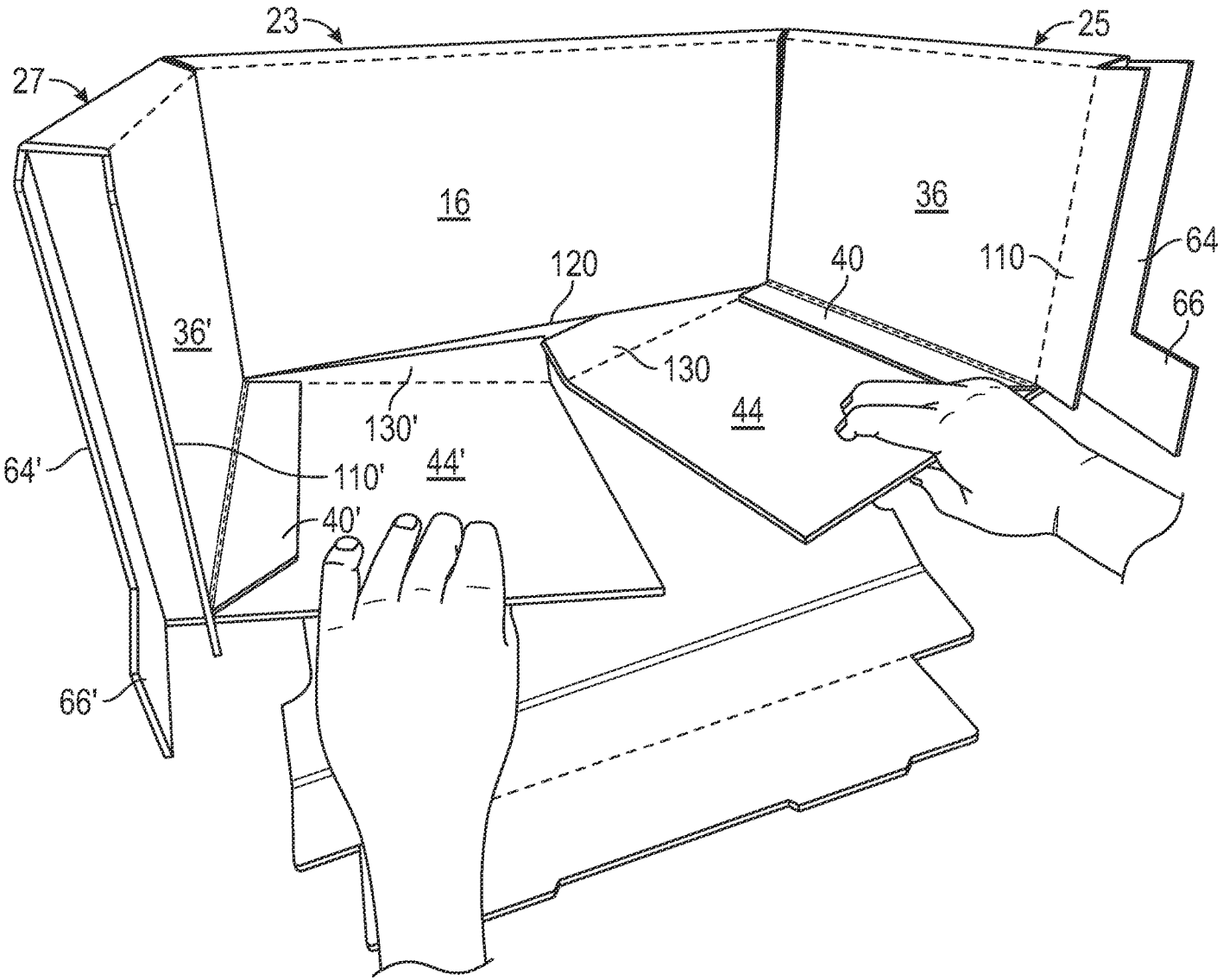
FIG. 17 illustrates yet another state of assembly of this third embodiment with the side walls and back wall shown in an upright orientation.
Figure 18:
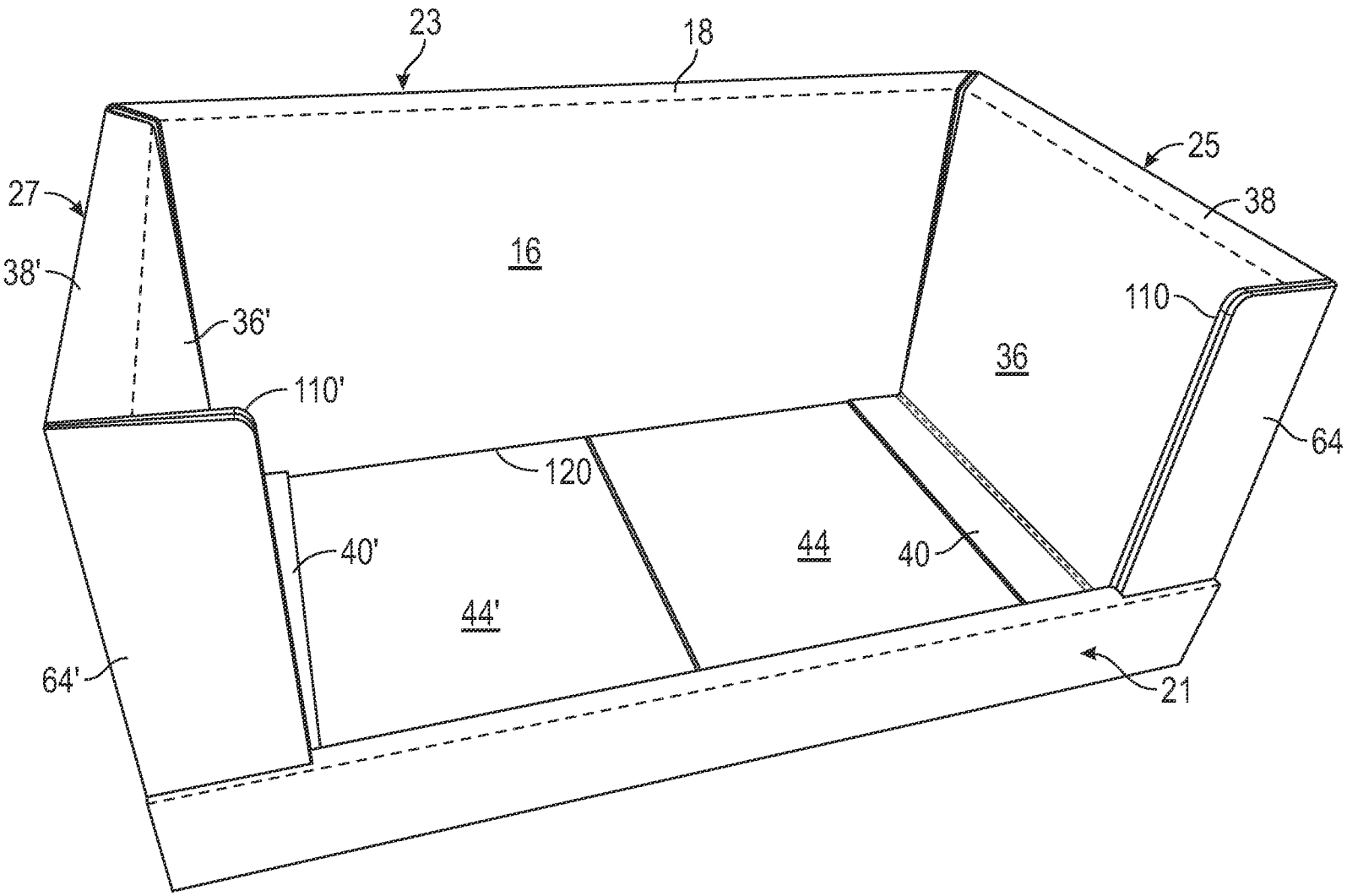
FIG. 18 illustrates a tray formed from the blank of FIG. 14 in a fully assembled state.

The embodiment of FIGS. 14-18 is the same as the embodiment of FIGS. 8-13 except that the glue tab/flap 20 has been eliminated from the inner back wall panel 16 and the lower edge 120 of the inner back wall panel 16 is desirably not secured to the bottom panel 24. In addition, each of the bottom-forming panel sections 44, 44' has a respective tuck tab section or tuck portion 130, 130' that is inserted beneath the lower edge 120 of the inner back wall panel 16 and into the gap between the inner back wall panel 16 and outer back wall panel 19. The tuck tabs 130, 130' can be sized to engage the interior surface of the outer wall panel and can extend at an upward angle between the inner and outer back wall panels to provide additional reinforcement at these locations. This embodiment also saves the expense of glue for securing the inner back wall panel in place. In FIG. 15, the inner wall panels 36, 16, and 36' are folded over onto the corresponding outer wall panels. FIGS. 16 and 17 illustrate the insertion of the tuck tab sections 130 and 131' into the space between the inner and outer back wall panels 16 and 19. The fully assembled tray is shown in FIG. 18.

As noted above, the tray embodiments described herein can be assembled from blanks comprising a single piece of material, such as corrugated paperboard/containerboard having one or more face sheets with a corrugated or fluted layer therebetween. The trays can also comprise any of a variety of other cellulosic fiber-based materials/cellulose-based materials, such as linerboard, kraft paper, multi-ply or single ply sheet materials, and the like.

One or more of the tray embodiments described herein can provide significant advantages over existing tray designs. For example, the multilayered corner reinforcing structures described herein can improve the vertical load-bearing capability of the trays, allowing multiple loaded trays to be stacked without buckling. Trays including the multilayered corner reinforcing structures described herein can also meet specified stacking strength requirements with wall panels that are thinner than traditional designs, thereby reducing material consumption and cost. Additionally, because the outer wall panels of the side walls and the back wall are coupled together by the reinforcing panels, all of the outer wall panels can be folded over in a single step during tray construction. This reduces the number of folding steps from three in existing designs where the outer wall panels are not coupled together, to a single folding step, thereby shortening assembly time.

Explanation of Terms

Throughout this disclosure, when a reference is made to a first element being coupled to a second element, the term "coupled" is to be construed to mean both direct connection of the elements as well as indirect connection of the elements by way of one or more additional intervening elements. Also, the singular terms "a", "and", and "first", mean both the singular and the plural unless the term is qualified to expressly indicate that it only refers to a singular element, such as by using the phase "only one". Thus, for example, if two of a particular element are present, there is also "a" or "an" of such element that is present. In addition, the term "and/or" when used in this document is to be construed to include the conjunctive "and", the disjunctive "or", and both "and" and "or". Also, the terms "includes" and "has" have the same meaning as "comprises" and the terms "including" and "having" have the same meaning as "comprising". The terms end, side, top and bottom are used for convenience with reference to the tray being oriented with the bottom surface of the bottom wall on a support surface such as the top of another box or tray, or other support such as another container or pallet. Due to manufacturing tolerances, box dimensions are typically specified to the nearest $1/32^{nd}$ of an inch (e.g. plus or minus $1/32^{nd}$ of an inch). Therefore, terms such as equal, the same, vertical and the like, unless qualified by the term "exactly", are met if within these manufacturing tolerances. The scope of this disclosure includes any features disclosed herein combined with any other features disclosed herein, unless physically impossible.

Although the operations of some of the disclosed embodiments are described in a particular, sequential order for convenient presentation, it should be understood that this manner of description encompasses rearrangement, unless a particular ordering is required by specific language set forth herein. For example, operations described sequentially may in some cases be rearranged or performed concurrently. Moreover, for the sake of simplicity, the attached figures may not show the various ways in which the disclosed components can be used in conjunction with other components.

In the description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

Having illustrated and described the principles of this technology with reference to exemplary embodiments, it should be apparent to those of ordinary skill in the art that the embodiments may be modified in arrangement and detail without departing from the principles of this disclosure. All such modifications are encompassed in this disclosure. We therefore claim all that comes within the scope and spirit of the following claims and their equivalents.

The invention claimed is:

1. A tray comprising:
- a back wall;
- at least two side walls;
- a front wall comprising an inner front wall panel portion and an outer front wall panel portion; and
- a bottom;
- the side walls each comprising an inner side wall panel and an outer side wall panel, a gap being provided between the inner and outer side wall panels;
- the back wall comprising an outer back wall panel and an inner back wall panel, a gap being provided between the inner back wall panel and the outer back wall panel;
- the inner back wall panel comprising first and second side edges, a top edge, and a bottom edge;
- a first of the inner side wall panels comprising a back edge, a front edge, a top edge, and a bottom edge; and
- wherein both a front edge of a first outer side wall panel and the front edge of the first inner side wall panel include flaps projecting outwardly therefrom along the front of the tray, and wherein only the outer of said flaps has a portion which is inserted between the outer and inner front wall panel portions of the tray.

2. The tray of claim 1, wherein the inner side wall panels each comprise a tab or section that is adhesively secured to a respective bottom-forming panel coupled to a lower edge of the adjacent outer side wall panel.

3. The tray of claim 2, wherein the bottom-forming panels each comprise a tuck portion inserted below the bottom edge of the inner back wall panel and into the gap between the inner and outer back wall panels.

4. The tray of claim 3, wherein the inner back wall panel is not secured to the bottom of the tray.

5. The tray of claim 3, wherein the tuck portions extend upward between the inner and outer back wall panels.

6. The tray of claim 1, wherein the inner back wall panel comprises a tab or section that is adhesively secured to a bottom-forming panel that is coupled to a lower edge of the outer back wall panel.

7. The tray of claim 1, wherein the flaps of the first outer side wall panel and the first inner side wall panel form a double-layered vertical structure on one side of the front wall.

8. The tray of claim 7, wherein the tray comprises double-layered vertical wall structures on either side of the front wall.

9. The tray of claim 1, wherein the inner front wall panel portion of the front wall abuts the flap of the first inner side wall panel.

10. The tray of claim 9, wherein the inner front wall panel portion is coplanar with the flap of the first inner side wall panel.

11. A tray comprising:

a back wall;

at least two side walls;

a front wall comprising an inner front wall panel portion and an outer front wall panel portion; and a bottom;

the side walls each comprising an inner side wall panel and an outer side wall panel, a gap being provided between the inner and outer side wall panels;

the back wall comprising an outer back wall panel and an inner back wall panel, a gap being provided between the inner back wall panel and the outer back wall panel;

the inner back wall panel comprising first and second side edges, a top edge, and a bottom edge;

a first of the inner side wall panels comprising a back edge, a front edge, a top edge, and a bottom edge;

wherein both a front edge of a first outer side wall panel and the front edge of the first inner side wall panel include flaps projecting outwardly therefrom along the front of the tray, and wherein only the outer of said flaps has a portion which is inserted between the outer and inner front wall panel portions of the tray; and wherein the bottom-forming panels each comprise a tuck portion inserted below the bottom edge of the inner back wall panel and into the gap between the inner and outer back wall panels.

12. The tray of claim 11, wherein the inner side wall panels each comprise a tab or section that is adhesively secured to a respective bottom-forming panel coupled to a lower edge of the adjacent outer side wall panel.

13. The tray of claim 11, wherein the inner back wall panel comprises a tab or section that is adhesively secured to a bottom-forming panel that is coupled to a lower edge of the outer back wall panel.

14. The tray of claim 11, wherein the flaps of the first outer side wall panel and the first inner side wall panel form a double-layered vertical structure on one side of the front wall.

15. The tray of claim 14, wherein the tray comprises double-layered vertical wall structures on either side of the front wall.

16. The tray of claim 11, wherein the inner front wall panel portion of the front wall abuts the flap of the first inner side wall panel.

17. The tray of claim 16, wherein the inner front wall panel portion is coplanar with the flap of the first inner side wall panel.

18. The tray of claim 11, wherein the inner back wall panel is not secured to the bottom of the tray.

19. The tray of claim 11, wherein the tuck portions extend upward between the inner and outer back wall panels.

20. A tray comprising:

a back wall;

at least two side walls;

a front wall comprising an inner front wall panel portion and an outer front wall panel portion; and a bottom;

the side walls each comprising an inner side wall panel and an outer side wall panel, a gap being provided between the inner and outer side wall panels;

the back wall comprising an outer back wall panel and an inner back wall panel, a gap being provided between the inner back wall panel and the outer back wall panel;

the inner back wall panel comprising first and second side edges, a top edge, and a bottom edge;

a first of the inner side wall panels comprising a back edge, a front edge, a top edge, and a bottom edge;

wherein both a front edge of a first outer side wall panel and the front edge of the first inner side wall panel include flaps projecting outwardly therefrom along the front of the tray, and wherein the inner front wall panel portion of the front wall abuts the flap of the first inner side wall panel; and wherein the inner front wall panel portion is coplanar with the flap of the first inner side wall panel.

21. The tray of claim 20, wherein:

both a front edge of a second outer side wall panel and a front edge of a second inner side wall panel include flaps projecting outwardly therefrom along the front of the tray; and only the flaps of the first and second outer side wall panels have portions which are inserted between the outer and inner front wall panel portions of the tray.

* * * * *